US010204581B2

(12) United States Patent
Du

(10) Patent No.: US 10,204,581 B2
(45) Date of Patent: Feb. 12, 2019

(54) SCAN DRIVING CIRCUIT AND FLAT PANEL DISPLAY

(71) Applicant: Shenzhen China Star Optoelectronics Technology Co. Ltd., Shenzhen, Guangdong (CN)

(72) Inventor: Peng Du, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 224 days.

(21) Appl. No.: 15/123,764

(22) PCT Filed: Jul. 1, 2016

(86) PCT No.: PCT/CN2016/090784
§ 371 (c)(1),
(2) Date: Sep. 6, 2016

(87) PCT Pub. No.: WO2018/000487
PCT Pub. Date: Jan. 4, 2018

(65) Prior Publication Data

US 2018/0218696 A1 Aug. 2, 2018

(30) Foreign Application Priority Data

Jul. 1, 2016 (CN) ..... 2016 1 0519471

(51) Int. Cl.
*G09G 3/36* (2006.01)

(52) U.S. Cl.
CPC ..... *G09G 3/3677* (2013.01); *G09G 3/36* (2013.01); *G09G 2300/0465* (2013.01); *G09G 2310/08* (2013.01)

(58) Field of Classification Search
CPC ..... G09G 3/3677; G09G 2300/0465; G09G 2310/08
See application file for complete search history.

(56) References Cited

U.S. PATENT DOCUMENTS 8,396,183 B2 3/2013 Yang et al.
9,087,596 B2 7/2015 Su et al.
(Continued)

FOREIGN PATENT DOCUMENTS

CN 102650751 A 8/2012
CN 104332182 A 2/2015

*Primary Examiner* — Ryan A Lubit
(74) *Attorney, Agent, or Firm* — Andrew C. Cheng

(57) ABSTRACT

The present disclosure provides a scanning driving circuit and a flat panel display. The scanning driving circuit includes a plurality of cascaded scanning driving units, and each scanning driving unit includes an input circuit receiving a higher level transmission signal, a first clock signal and a second clock signal and outputting a present level transmission signal and a pull-up control signal; an output circuit receiving signal from the input circuit and outputting the lower level transmission signal; a control circuit receiving the first pull-down signal, the second pull-down signal and the pull-up control signal and outputting the scanning driving signal; a scan line receiving scanning driving signal and controlling the pixel unit, in order to meeting the driving demand of the charge sharing pixel while ensure the high aperture ratio of the charge sharing pixel and not affect the reliability of the scanning driving circuit.

20 Claims, 6 Drawing Sheets

(56) References Cited

U.S. PATENT DOCUMENTS

| | | | | |
|---|---|---|---|---|
| 2010/0238143 | A1* | 9/2010 | Liu | G09G 3/20 345/204 |
| 2013/0100007 | A1* | 4/2013 | Yamamoto | G09G 3/3677 345/100 |
| 2015/0339997 | A1* | 11/2015 | Yang | G09G 3/3677 345/212 |
| 2016/0064097 | A1 | 3/2016 | Yang et al. | |
| 2016/0253975 | A1* | 9/2016 | Yang | G11C 19/28 345/58 |
| 2017/0221439 | A1* | 8/2017 | Chen | G09G 3/3648 |
| 2018/0061347 | A1* | 3/2018 | Zhang | G09G 3/3677 |

* cited by examiner

SCAN DRIVING CIRCUIT AND FLAT PANEL DISPLAY

FIELD OF THE DISCLOSURE

The present disclosure relates to a display technology field, and more particularly to a scanning driving circuit and a flat panel display.

BACKGROUND OF THE DISCLOSURE

Vertical alignment (VA) liquid crystal mode has advantages of high contrast, fast response time and high penetration rates, etc. and has been widely used. Wide viewing angle performance of the VA mode is divided each VA sub-pixel as Main area and Sub area, the Main area is the same as the normal sub-pixel, the Sub area is generated a voltage difference with the Main area through various circuit design, in order to achieve wide viewing angle performance, however the pixel used this design always has two scan lines, wherein the first scan line normal charging the Main area and the Sub area respectively, the second scan line controls a thin film transistor (TFT) to charge sharing with the Sub area, in order to achieve the voltage difference of the Main area and the Sub area, since two scan lines will occupy part of the space, resulting in decreased the pixel aperture ratio, and therefore merged the second scan line and the scan line of the next level pixel to increase the pixel aperture ratio, but such designs require two scan lines cannot simultaneously opened, otherwise the Main area and the Sub area cannot generate a voltage difference, in the existing large-size panel scanning driving circuit design, since the circuit load and other factors, often are used 4CK, 6CK or 8CK a plurality of clock signals, the scanning driving signal generated by this circuit cannot satisfied the needs of driving pixel of the above, so the above problem needs to be improved.

SUMMARY OF THE DISCLOSURE

The technical problem of the present disclosure to solve is providing a scanning driving circuit and a flat panel display, in order to meeting the driving demand of the pixel while ensure the high aperture ratio of the pixel and the reliability of the scanning driving circuit.

In order to solve the above problems, an aspect of the present disclosure is used: providing a scanning driving circuit, the scanning driving circuit includes a plurality of cascaded scanning driving units, each scanning driving unit includes:

an input circuit is used to receive a higher level transmission signal, a first clock signal, a second clock signal and output a present level transmission signal and a pull-up control signal according to the received higher level transmission signal, the received first clock signal and the received second clock signal;

an output circuit connected with the input circuit is used to receive the signal from the input circuit and output the lower level transmission signal according to the received signal;

a control circuit connected with the input circuit is used to receive a first pull-down signal, a second pull-down signal and the pull-up control signal and output the scanning driving signal according to the received first pull-down signal, the received second pull-down signal and the received pull-up control signal, or is used to receive the first clock signal, the higher level transmission signal, the third clock signal and the pull-up control signal and output the scanning driving signal according to the first clock signal, the higher level transmission signal, the third clock signal and the pull-up control signal;

and a scan line connected with a pixel unit is used to receive the scanning driving signal from the control circuit and control the pixel unit according to the received scanning driving signal.

Wherein, the input circuit includes first to third controllable switches and capacitor, the control terminal of the first controllable switch connects the first end of the first controllable switch and receives the higher level transmission signal, the second end of the first controllable switch connects the control circuit, the output circuit and the control end of the second controllable switch, the first end of the second controllable switch receives the first clock signal, the first end of the capacitor connects the control terminal of the second controllable switch and outputs the pull-up control signal, the second end of the second controllable switch connects the second end of the capacitor and outputs the present level transmission signal, the control terminal of the third controllable switch connects the control terminal of the second controllable switch, the first end of the third controllable switch connects the second clock signal, the second end of the third controllable switch connects the scan line.

Wherein, the output circuit includes fourth to fifth controllable switches, the control terminal of the fourth controllable switch connects with the control terminal of the fifth controllable switch and outputs the lower level transmission signal, the first end of the fourth controllable switch connects the second end of the first controllable switch, the first end of the fifth controllable switch connects the scan line, the second ends of the fourth and fifth controllable switch are grounded.

Wherein, the control circuit includes sixth to seventeenth controllable switches, the control terminal of the sixth controllable switch connects the first end of the sixth controllable switch and the first end of the eighth controllable switch and receives the first pull-down signal, the second end of the sixth controllable switch connects the control terminal of the eighth controllable switch and the first end of the seventh controllable switch, the control terminal of the seventh controllable switch connects the control terminal of the ninth controllable switch and receives the pull-up control signal, the second end of the eight controllable switch connects the control terminal of the tenth controllable switch, the control terminal of the eleventh controllable switch and the first end of the ninth controllable switch, the first end of the tenth controllable switch connects the second end of the first controllable switch, the first end of the eleventh controllable switch connects the scan line, the control terminal of the twelfth controllable switch connects the first end of the twelfth controllable switch and the first end of the fourteenth controllable switch and receives the second pull-down signal, the second end of the twelfth controllable switch connects the control terminal of the fourteenth controllable switch and the first end of the thirteenth controllable switch, the control terminal of the thirteenth controllable switch connects the control terminal of the fifteenth controllable switch and receives the pull-up control signal, the second end of the fourteenth controllable switch connects the control terminal of the sixteenth controllable switch, the control terminal of the seventeenth controllable switch and the first end of the fifteenth controllable switch, the first end of the sixteenth controllable switch connects the second end of the first controllable switch, the first end of the seventeenth controllable switch connects the scan line, the seventh controllable switch, the ninth controllable switch, the tenth controllable switch, the eleventh controllable switch, the thirteenth controllable switch, the fifth controllable switch, the sixteenth controllable switch and the second end of the seventeenth controllable switch are grounded.

Wherein, the control circuit includes sixth to thirteenth controllable switches, the control terminal of the sixth controllable switch connects the first end of the sixth controllable switch and the first end of the eighth controllable switch and receives the first clock signal, the second end of the sixth controllable switch connects the control terminal of the eighth controllable switch and the first end of the seventh controllable switch, the control terminal of the seventh controllable switch connects the control terminal of the ninth controllable switch and receives the pull-up control signal, the second end of the eighth controllable switch connects the control terminal of the tenth controllable switch, the control terminal of the eleventh controllable switch and the first end of the ninth controllable switch, the first end of the tenth controllable switch connects the second end of the first controllable switch, the first end of the eleventh controllable switch connects the scan line, the control terminal of the twelfth controllable switch connects the control terminal of the thirteenth controllable switch and receives the third clock signal, the first end of the twelfth controllable switch connects the second end of the first controllable switch, the second end of the twelfth controllable switch connects the higher level transmission signal, the first end of the thirteenth controllable switch connects the scan line, the second ends of the seventh controllable switch, the ninth controllable switch, the tenth controllable switch, the eleventh controllable switch and thirteenth controllable switch are grounded.

Wherein, the frequency of the first clock signal is half of the frequency of the second clock signal, the scanning driving signal is constituted by two discrete pulse signals, the first pulse signal is used to pre-charging, the second pulse signal is used to charge the present level pixel.

Wherein, the frequency of the first clock signal is ⅓ of the frequency of the second clock signal, the scanning driving signal is constituted by three discrete pulse signals, the first and the second pulse signals are used to pre-charging, the third pulse signal is used to charge the present level pixel.

Wherein, the frequency of the first clock signal is ¼ of the frequency of the second clock signal, the scanning driving signal is constituted by four discrete pulse signals, the first to third pulse signal are used to pre-charging, the fourth pulse signal is used to charge the present level pixel.

Wherein, the first to seventeenth controllable switches are N-type thin film transistors.

Wherein, the first to thirteenth controllable switches are N-type thin film transistors.

In order to solve the above problems, another aspect of the present disclosure is used: providing a flat panel display, the flat panel display includes a scanning driving circuit, the scanning driving circuit includes a plurality of cascaded scanning driving units, and each scanning driving unit includes:

an input circuit is used to receive a higher level transmission signal, a first clock signal, a second clock signal and output a present level transmission signal and a pull-up control signal according to the received higher level transmission signal, the received first clock signal and the received second clock signal;

an output circuit connected with the input circuit is used to receive the signal from the input circuit and output the lower level transmission signal according to the received signal;

a control circuit connected with the input circuit is used to receive a first pull-down signal, a second pull-down signal and the pull-up control signal and output the scanning driving signal according to the received first pull-down signal, the received second pull-down signal and the received pull-up control signal, or is used to receive the first clock signal, the higher level transmission signal, the third clock signal and the pull-up control signal and output the scanning driving signal according to the first clock signal, the higher level transmission signal, the third clock signal and the pull-up control signal;

and a scan line connected with a pixel unit is used to receive the scanning driving signal from the control circuit and control the pixel unit according to the received scanning driving signal.

Wherein, the input circuit includes first to third controllable switches and capacitor, the control terminal of the first controllable switch connects the first end of the first controllable switch and receives the higher level transmission signal, the second end of the first controllable switch connects the control circuit, the output circuit and the control terminal of the second controllable switch, the first end of the second controllable switch receives the first clock signal, the first end of the capacitor connects the control terminal of the second controllable switch and outputs the pull-up control signal, the second end of the second controllable switch connects the second end of the capacitor and outputs the present level transmission signal, the control terminal of the third controllable switch connects the control terminal of the second controllable switch, the first end of the third controllable switch connects the second clock signal, the second end of the third controllable switch connects the scan line.

Wherein, the output circuit includes fourth to fifth controllable switches, the control terminal of the fourth controllable switch connects with the control terminal of the fifth controllable switch and outputs the lower level transmission signal, the first end of the fourth controllable switch connects the second end of the first controllable switch, the first end of the fifth controllable switch connects the scan line, the second ends of the fourth and fifth controllable switch are grounded.

Wherein, the control circuit includes sixth to seventeenth controllable switches, the control terminal of the sixth controllable switch connects the first end of the sixth controllable switch and the first end of the eighth controllable switch and receives the first pull-down signal, the second end of the sixth controllable switch connects the control terminal of the eighth controllable switch and the first end of the seventh controllable switch, the control terminal of the seventh controllable switch connects the control terminal of the ninth controllable switch and receives the pull-up control signal, the second end of the eight controllable switch connects the control terminal of the tenth controllable switch, the control terminal of the eleventh controllable switch and the first end of the ninth controllable switch, the first end of the tenth controllable switch connects the second end of the first controllable switch, the first end of the eleventh controllable switch connects the scan line, the control terminal of the twelfth controllable switch connects the first end of the twelfth controllable switch and the first end of the fourteenth controllable switch and receives the second pull-down signal, the second end of the twelfth controllable switch connects the control terminal of the fourteenth controllable switch and the first end of the thirteenth controllable switch, the control terminal of the thirteenth controllable switch connects the control terminal of the fifteenth controllable switch and receives the pull-up control signal, the second end of the fourteenth controllable switch connects the control terminal of the sixteenth controllable switch, the control terminal of the seventeenth controllable switch and the first end of the fifteenth controllable switch, the first end of the sixteenth controllable switch connects the second end of the first controllable switch, the first end of the seventeenth controllable switch connects the scan line, the seventh controllable switch, the ninth controllable switch, the tenth controllable switch, the eleventh controllable switch, the thirteenth controllable switch, the fifth controllable switch, the sixteenth controllable switch and the second end of the seventeenth controllable switch are grounded.

Wherein, the control circuit includes sixth to thirteenth controllable switches, the control terminal of the sixth controllable switch connects the first end of the sixth controllable switch and the first end of the eighth controllable switch and receives the first clock signal, the second end of the sixth controllable switch connects the control terminal of the eighth controllable switch and the first end of the seventh controllable switch, the control terminal of the seventh controllable switch connects the control terminal of the ninth controllable switch and receives the pull-up control signal, the second end of the eighth controllable switch connects the control terminal of the tenth controllable switch, the control terminal of the eleventh controllable switch and the first end of the ninth controllable switch, the first end of the tenth controllable switch connects the second end of the first controllable switch, the first end of the eleventh controllable switch connects the scan line, the control terminal of the twelfth controllable switch connects the control terminal of the thirteenth controllable switch and receives the third clock signal, the first end of the twelfth controllable switch connects the second end of the first controllable switch, the second end of the twelfth controllable switch connects the higher level transmission signal, the first end of the thirteenth controllable switch connects the scan line, the second ends of the seventh controllable switch, the ninth controllable switch, the tenth controllable switch, the eleventh controllable switch and thirteenth controllable switch are grounded.

Wherein, the frequency of the first clock signal is half of the frequency of the second clock signal, the scanning driving signal is constituted by two discrete pulse signals, the first pulse signal is used to pre-charging, the second pulse signal is used to charge the present level pixel.

Wherein, the frequency of the first clock signal is ⅓ of the frequency of the second clock signal, the scanning driving signal is constituted by three discrete pulse signals, the first and the second pulse signals are used to pre-charging, the third pulse signal is used to charge the present level pixel.

Wherein, the frequency of the first clock signal is ¼ of the frequency of the second clock signal, the scanning driving signal is constituted by four discrete pulse signals, the first to third pulse signal are used to pre-charging, the fourth pulse signal is used to charge the present level pixel.

Wherein, the first to seventeenth controllable switches are N-type thin film transistors.

Wherein, the first to thirteenth controllable switches are N-type thin film transistors.

The beneficial effects of the present disclosure are: the situation is different from the prior art, the scanning driving circuit of the present disclosure makes the scanning driving signal waveform of each scanning driving units outputted of the scanning driving circuit without overlapping portion through the design of the input circuit, the control circuit and the output circuit, in order to meeting the driving demand of the charge sharing pixel while ensure the high aperture ratio of the charge sharing pixel and not affect the reliability of the scanning driving circuit.

DETAILED DESCRIPTION OF PREFERRED EMBODIMENTS

Figure 1:
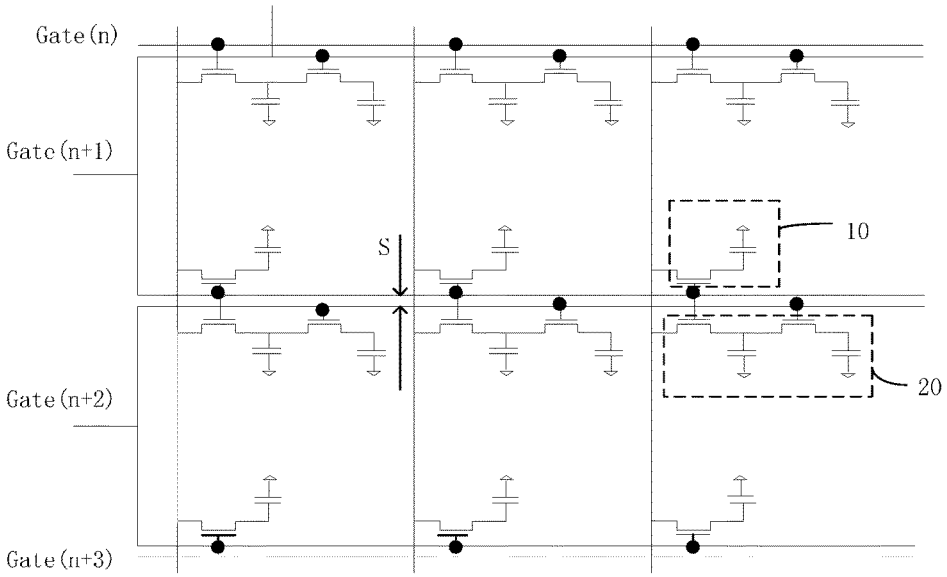
FIG. 1 (Prior Art)
FIG. 1 is a circuit diagram of a scanning driving circuit of the prior art.

Please refer to FIG. 1, the FIG. 1 is a circuit diagram of one scanning driving circuit of the VA mode liquid crystal panel in the prior art. In the VA mode liquid crystal panel, in order to improve the display characteristics of wide viewing angle, the charge sharing is a very common design, the use of the pixel equivalent circuit of this design shown in FIG. 1. The two dotted boxes in the FIG. 1 represent a Main area 10 and a Sub area 20 of a sub-pixel, wherein the Main area 10 and the Sub area 20 is charging the pixel electrode by a TFT respectively, the gate electrode of the TFT of the Main area 10 and the gate electrode of a TFT of the Sub area 20 are connect the first scan line Gate (n+1) and another TFT of the Sub area 20 further connects the second scan line Gate (n+2) at same time, when the second scan line Gate(n+2) is opening, another TFT of the Sub area 20 may charge sharing to the Sub area 20, so that the potential of the Sub area 20 is closer to the COM potential, in order to achieve the voltage difference of the pixel electrode of the Main area 10 and Sub area 20, however, each sub-pixels in FIG. 1 needs arranging two scan lines, this two scan line are often formed by same layer metal, they need to maintain a relatively large spacing between them (the S in FIG. 1 represents the spacing between the two scan lines) to prevent the signal line short-circuit, the disadvantage of this approach is two scan lines require more open space, and thus adversely affect the transmittance of the pixel.

Figure 2:
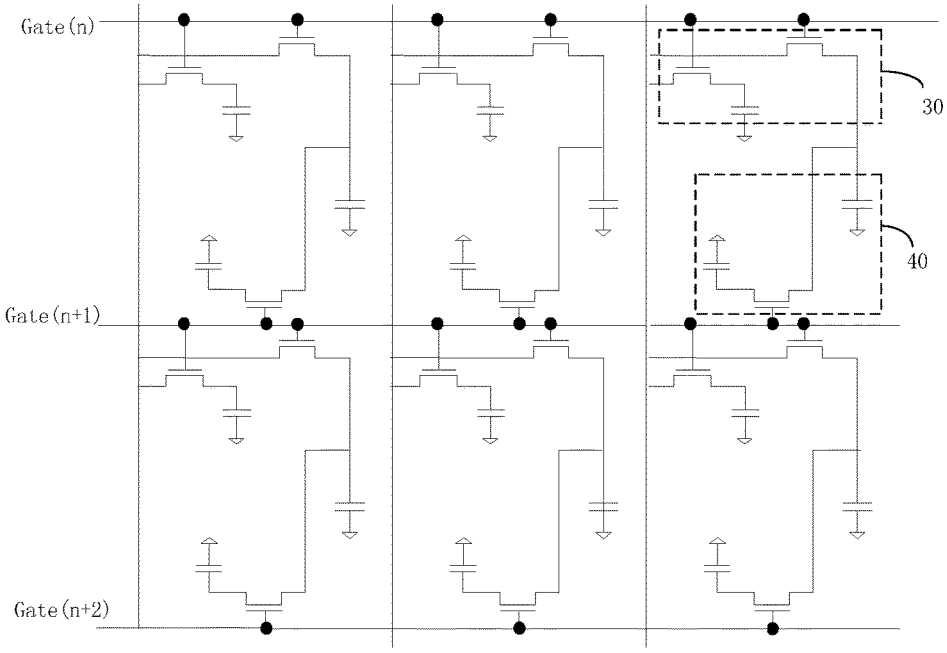
FIG. 2 (Prior Art)
FIG. 2 is a circuit diagram of another scanning driving circuit of the prior art.
Figure 3:
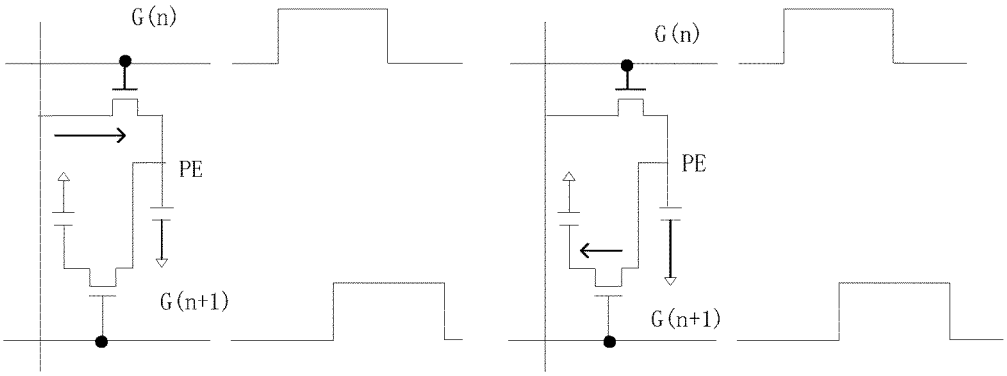
FIG. 3 is a principle diagram of the charge sharing pixel in the FIG. 2.
Figure 4:
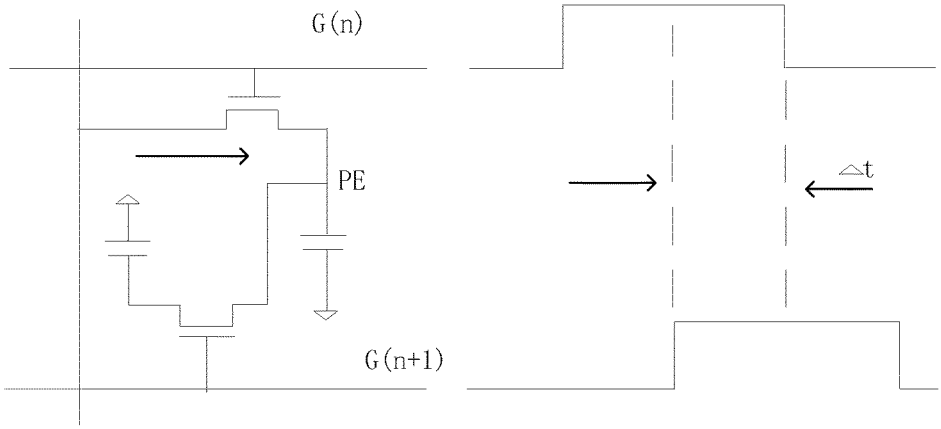
FIG. 4 is a principle diagram of the pixel in normal working in the FIG. 2.

Please refer to FIG. 2, the FIG. 2 is a circuit diagram of another scanning driving circuit of the prior art. The circuit shown in FIG. 2 is the circuit shown in FIG. 1 has been improved, it will control the merge of the scan line connected with the TFT of the charge sharing of the Sub area 40 and scan line connected with the TFT of the next level pixel charge, so that each sub-pixel arrangement only requires a scan line to improve the penetration rate, the Main area 30 of the pixel of the scanning driving circuit shown in FIG. 2 and the normal pixel works in the same, here only introduce the working principle of the Sub area 40. The circuit in FIG. 3 is the equivalent circuit of the Sub area 40, the right side is the driving waveforms of the two scan lines, the scanning driving signal G(n) is high potential, the scanning driving signal G(n+1) is low potential, in this case open the TFT used to charge, charging the pixel electrode through the data line (the arrow on the left side in the FIG. 3), after charging, the potentials of the pixel electrode and the data line are the same, the next is open the next level gate line, the scanning driving signal G(n+1) is high potential, the scanning driving signal G(n) is low potential, the second TFT is turned on, it will connect the pixel electrode to a coupling capacitor, by the capacitive coupling effect causes the pixel electrode potential of the Sub area 40 controlling the COM potential closer, resulting the voltage difference of the Main area 30 and the Sub area 40, however, if the two gate line corresponding to the sub-pixel open simultaneously, i.e. the successive two scanning driving signal has the overlapping case (shown in FIG. 4), the length of time of two successive scanning drive signal superimposed is Δt, at this point the two TFTs in the sub-pixel will open simultaneously, all capacitors are in parallel, the pixel electrode will be charged through the data line, and after the end of the charging time, the pixel electrode voltage will not change, therefore, the voltage difference of the Main area 30 and the Sub area 40 cannot be achieved, the pixel work of the charge sharing fails, it can be seen, when the pixel of the charge sharing working in normal, the scanning driving signal of the two adjacent scan line cannot have overlapping part.

Figure 5:
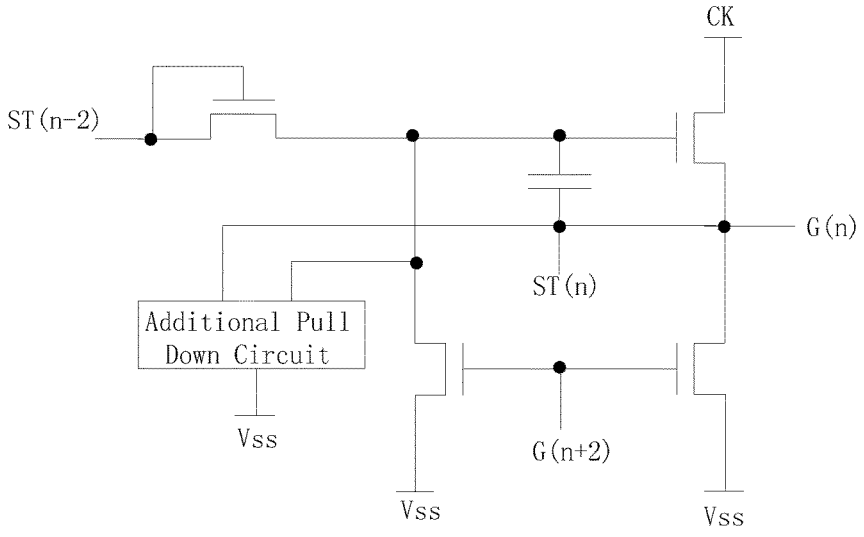
FIG. 5 is a circuit diagram of the scanning driving circuit of large-size panel in the prior art.
Figure 6:
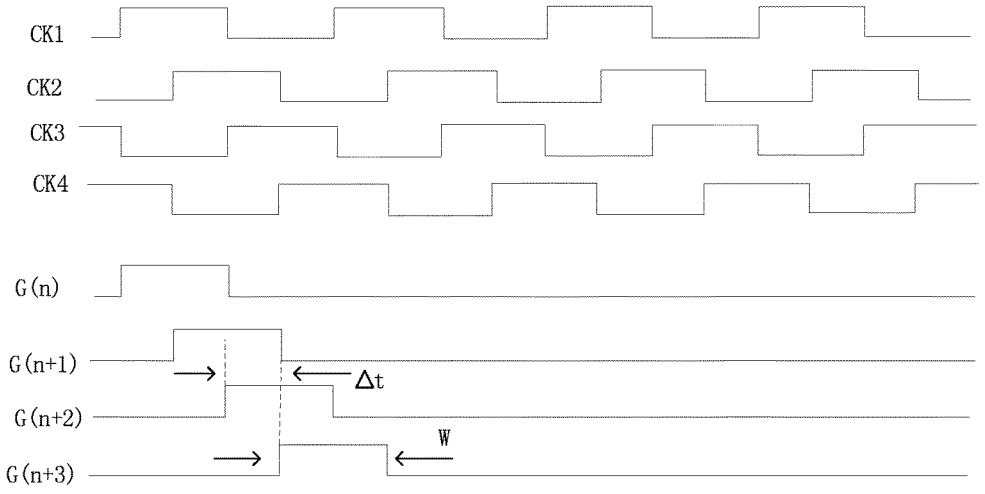
FIG. 6 is an output waveform diagram of the scanning driving circuit in the FIG. 5.

Please refer to FIG. 5, FIG. 5 is a circuit diagram of the scanning driving circuit of large-size panel in the prior art. Due to the delay of the large-size panel circuit is more serious, the scanning driving circuit often use a plurality of clock signal designs like 4CK, 6CK, 8CK, etc., such the two adjacent scanning driving signal of the scanning driving circuit outputted must have overlapping portions, the scanning driving circuit in FIG. 5 as an example, use the design of 4CK, the output waveform diagram of the scanning driving circuit as shown in FIG. 6, the scanning driving signal G(n), G(n+1), G(n+2) and G(+3) in FIG. 6 is the output waveform of the adjacent four level scanning driving circuit, it can be seen from FIG. 6, when the duty cycle of the clock signal CK is 50% and the pulse width of the scanning driving signal is W, the length of time of the overlap portion of the adjacent two level scanning driving signal Δt=W/2, i.e. half the time is overlapped, so the scanning driving signal does not meet the driving requirement of the charge sharing pixel.

Figure 7:
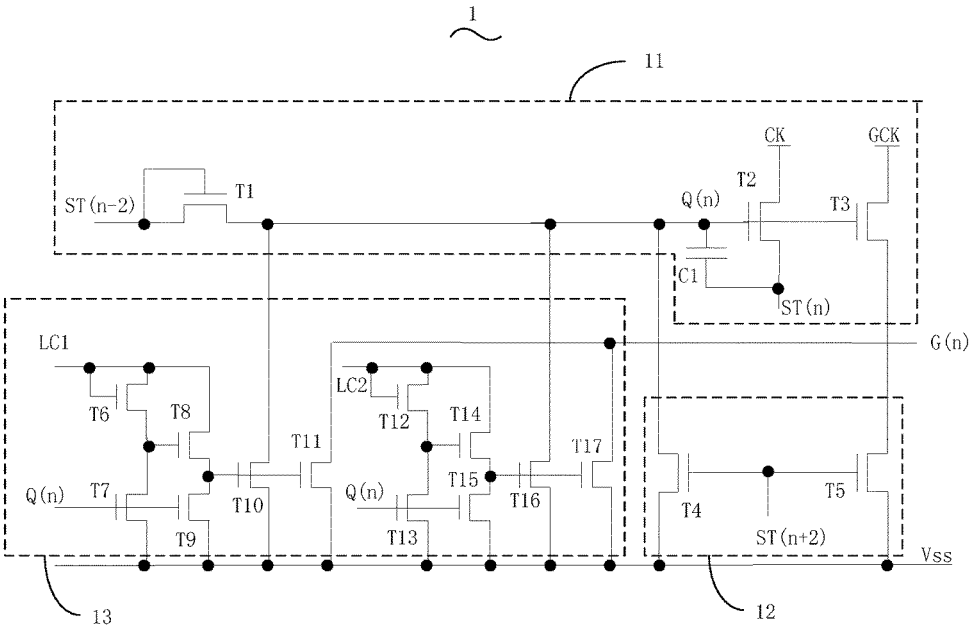
FIG. 7 is a circuit diagram of the first embodiment of the scanning driving circuit of the present disclosure.

Please refer to FIG. 7, FIG. 7 is a circuit diagram of the first embodiment of the scanning driving circuit of the present disclosure. In the present embodiment, in 4CK clock signal as an example. As shown in FIG. 3, the scanning driving circuit of the present disclosure includes a plurality of cascaded scanning driving units 1, each scanning driving unit 1 includes an input circuit 11 is used to receive a higher level transmission signal, a first clock signal, a second clock signal and output a present level transmission signal and a pull-up control signal according to the received higher level transmission signal, the received first clock signal and the received second clock signal; an output circuit 12 connected with the input circuit 11 is used to receive the signal from the input circuit 11 and output the lower level transmission signal according to the received signal; a control circuit 13 connected with the input circuit 11 is used to receive a first pull-down signal, a second pull-down signal and the pull-up control signal and output the scanning driving signal according to the received first pull-down signal, the received second pull-down signal and the received pull-up control signal, or is used to receive the first clock signal, the higher level transmission signal, the third clock signal and the pull-up control signal and output the scanning driving signal according to the first clock signal, the higher level transmission signal, the third clock signal and the pull-up control signal; a scan line connected with a pixel unit is used to receive the scanning driving signal from the control circuit 13 and control the pixel unit according to the received scanning driving signal.

Wherein, the input circuit 11 includes first to third controllable switches T1-T3 and capacitor C1, the control terminal of the first controllable switch T1 connects the first end of the first controllable switch T1 and receives the higher level transmission signal, the second end of the first controllable switch T1 connects the control circuit 13, the output circuit 12 and the control terminal of the second controllable switch T2, the first end of the second controllable switch T2 receives the first clock signal, the first end of the capacitor C1 connects the control terminal of the second controllable switch T2 and outputs the pull-up control signal, the second end of the second controllable switch T2 connects the second end of the capacitor C1 and outputs the present level transmission signal, the control terminal of the third controllable switch T3 connects the control terminal of the second controllable switch T2, the first end of the third controllable switch T3 connects the second clock signal, the second end of the third controllable switch T3 connects the scan line.

Wherein, the output circuit 12 includes fourth to fifth controllable switches T4, T5, the control terminal of the fourth controllable switch T4 connects with the control terminal of the fifth controllable switch T5 and outputs the lower level transmission signal, the first end of the fourth controllable switch T4 connects the second end of the first controllable switch T1, the first end of the fifth controllable switch T5 connects the scan line, the second ends of the fourth and fifth controllable switch T4, T5 are grounded.

Wherein, the control circuit 13 includes sixth to seventeenth controllable switches T6-T17, the control terminal of the sixth controllable switch T6 connects the first end of the sixth controllable switch T6 and the first end of the eighth controllable switch T8 and receives the first pull-down signal, the second end of the sixth controllable switch T6 connects the control terminal of the eighth controllable switch T8 and the first end of the seventh controllable switch T7, the control terminal of the seventh controllable switch T7 connects the control terminal of the ninth controllable switch T9 and receives the pull-up control signal, the second end of the eight controllable switch T8 connects the control terminal of the tenth controllable switch T10, the control terminal of the eleventh controllable switch T11 and the first end of the ninth controllable switch T9, the first end of the tenth controllable switch T10 connects the second end of the first controllable switch T1, the first end of the eleventh controllable switch T11 connects the scan line, the control terminal of the twelfth controllable switch T12 connects the first end of the twelfth controllable switch T12 and the first end of the fourteenth controllable switch T14 and receives the second pull-down signal, the second end of the twelfth controllable switch T12 connects the control terminal of the fourteenth controllable switch T14 and the first end of the thirteenth controllable switch T13, the control terminal of the thirteenth controllable switch T13 connects the control terminal of the fifteenth controllable switch T15 and receives the pull-up control signal, the second end of the fourteenth controllable switch T14 connects the control terminal of the sixteenth controllable switch T16, the control terminal of the seventeenth controllable switch T17 and the first end of the fifteenth controllable switch T15, the first end of the sixteenth controllable switch T16 connects the second end of the first controllable switch T1, the first end of the seventeenth controllable switch T17 connects the scan line, the seventh controllable switch T7, the ninth controllable switch T9, the tenth controllable switch T10, the eleventh controllable switch T11, the thirteenth controllable switch T13, the fifth controllable switch T15, the sixteenth controllable switch T16 and the second end of the seventeenth controllable switch T17 are grounded.

In the present embodiment, the first to seventeenth controllable switches T1-T17 are N-type thin film transistors. In another embodiment, the first to seventeenth controllable switches T1-T17 may be other types of switches, as long as achieve the purpose of the present disclosure.

In the present embodiment, the higher level transmission signal is ST(n−2), the first clock signal is CK, the second clock signal is GCK, the pull-up control signal is Q(n), the present level transmission signal is ST(n), the first pull-down signal is LC1, the second pull-down signal is LC2, the lower level transmission signal is ST(n+2) and the present scanning driving signal is G(n).

Figure 8:
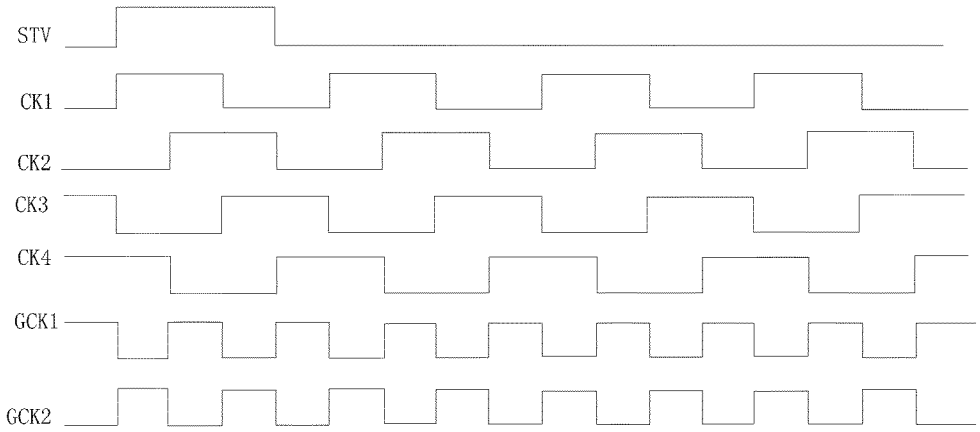
FIG. 8 is an input waveform diagram of the scanning driving circuit in the FIG. 7.

Please refer to FIG. 8, FIG. 8 is an input waveform diagram of the scanning driving circuit of the present disclosure. As shown in FIG. 8, the STV signal is start signal, its role is to open the first two levels scanning driving circuit when beginning, so that the scanning driving circuit level-transmit from first level, CK1-CK4 is first clock signal, it is the same as the conventional scanning driving circuit, in the conventional scanning driving circuit, the first clock signal CK may be used to output the present level transmission signal ST(n) and the scanning driving signal, the first clock signal CK in the present disclosure is used to output the present level transmission signal ST(n), the scanning driving circuit is outputted by the two inverted second clock signal GCK1 and GCK2, the waveforms of the second clock signal GCK1 and GCK2 and the first clock signal CK are periodic square wave, but the frequency of the second clock signal GCK1 and GCK2 and the first clock signal CK are different, each pulse width of the second clock signal GCK is roughly equivalent the open time of the gate line W when the panel working, With FHD resolution, 60 Hz refresh rate of the panels, for example, the time W is about 14 us, and the cycle of the first clock signal CK is longer, in 4CK as example, each cycle of the first clock signal CK is twice the second clock signal GCK, i.e. the frequency of the first clock signal CK is half the second clock signal GCK.

Figure 9:
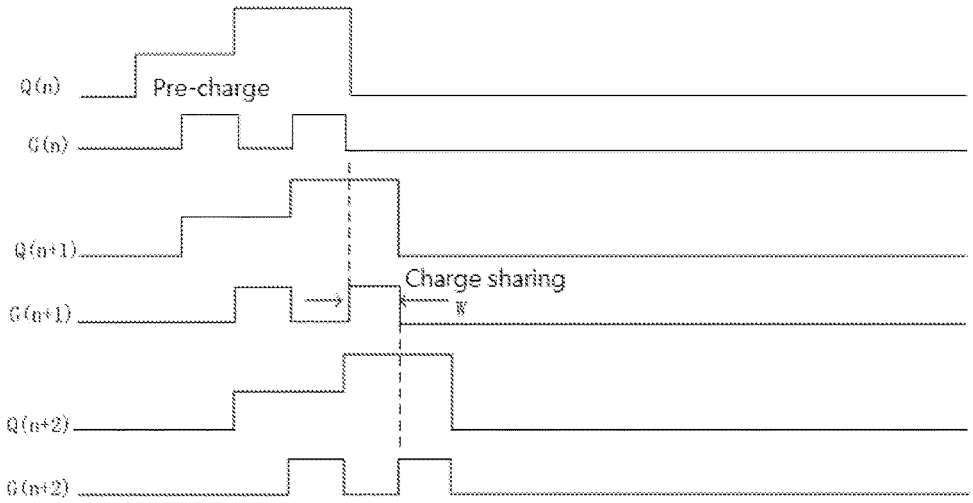
FIG. 9 is an output waveform diagram of the scanning driving circuit in the FIG. 7.

Please refer to FIG. 9, FIG. 9 is an output waveform diagram of the scanning driving circuit of the present disclosure. As shown in FIG. 9, compared to the output waveform of the pull-up control signal Q point voltage waveform and scanning driving signal of each level scanning driving circuit and the output waveform of the conventional scanning driving circuit in FIG. 6, the waveform of the pull-up control signal Q point in the FIG. 9 are exactly the same, is a two-level square wave, the waveform of the scanning driving signal compared with the conventional waveform of the scanning driving signal has significantly different, the main difference is it will divided into two discrete pulses when the gate line opening, the interval time between two pulses and the width of each pulse are substantially the same, in two pulses, the first pulse is pre-charging, at this time the data line corresponding to the pixel is written the first two level pixel signal, not the signal corresponding to the present level pixel, now that the vast majority panel have adopted the column inversion manner, therefore, the pre-charge is help to improve the situation of the panel charge, the second pulse of the scanning driving circuit outputted is used to charge the present level pixel, in this case the signal on the data line is corresponding to the signal of the present level pixel should be written, accordingly, the second pulse of the next level scanning driving circuit outputted is used to charge sharing the Sub area of the present level pixel, resulting generate the voltage difference between the pixel Main area and Sub area, to improve the wide viewing angle characteristics, compare the waveform of the scanning driving signal G(n), G(n+1) and G(n+2) in the FIG. 9 can also be found, the waveform of two adjacent gate line does not have the overlapping phenomenon, therefore, such a waveform can be applied on the pixel of the structure of the charge sharing, to solve the existing problems of the scanning driving circuit not compatible with the structure of the charge sharing.

Figure 10:
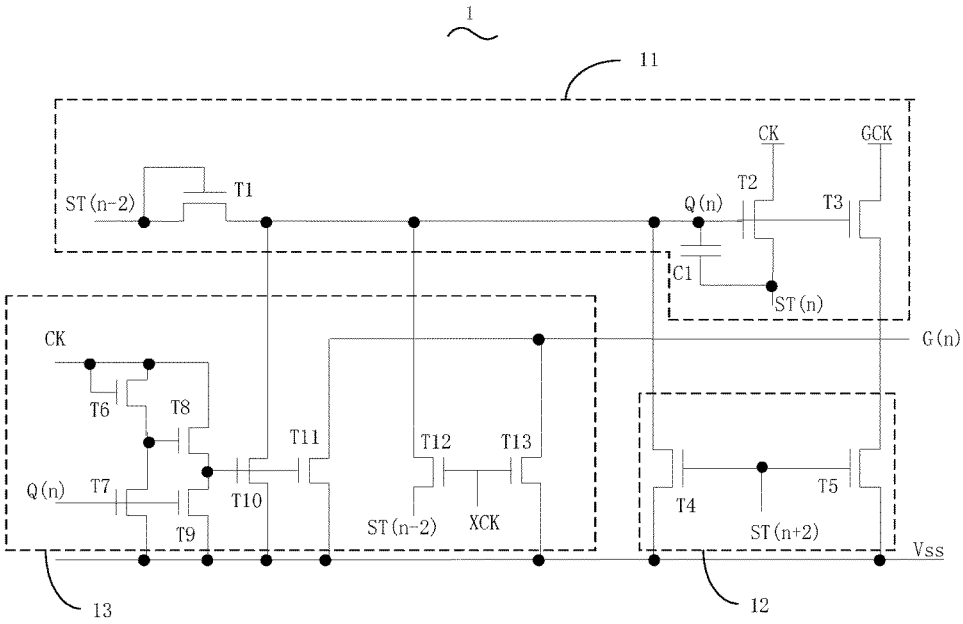
FIG. 10 is a circuit diagram of the second embodiment of the scanning driving circuit of the present disclosure.

Please refer to FIG. 10, FIG. 10 is a circuit diagram of the second embodiment of the scanning driving circuit of the present disclosure. The different between the second embodiment of the scanning driving circuit and the first embodiment of the scanning driving circuit is: the control circuit 13 includes sixth to thirteenth controllable switches T6-T13, the control terminal of the sixth controllable switch T6 connects the first end of the sixth controllable switch T6 and the first end of the eighth controllable switch T8 and receives the first clock signal, the second end of the sixth controllable switch T6 connects the control terminal of the eighth controllable switch T8 and the first end of the seventh controllable switch T7, the control terminal of the seventh controllable switch T7 connects the control terminal of the ninth controllable switch T9 and receives the pull-up control signal, the second end of the eighth controllable switch T8 connects the control terminal of the tenth controllable switch T10, the control terminal of the eleventh controllable switch T11 and the first end of the ninth controllable switch T9, the first end of the tenth controllable switch T10 connects the second end of the first controllable switch T1, the first end of the eleventh controllable switch T11 connects the scan line, the control terminal of the twelfth controllable switch T12 connects the control terminal of the thirteenth controllable switch T13 and receives the third clock signal, the first end of the twelfth controllable switch T12 connects the second end of the first controllable switch T1, the second end of the twelfth controllable switch T12 connects the higher level transmission signal, the first end of the thirteenth controllable switch T13 connects the scan line, the second ends of the seventh controllable switch T7, the ninth controllable switch T9, the tenth controllable switch T10, the eleventh controllable switch T11 and thirteenth controllable switch T13 are grounded.

In the present embodiment, the first to thirteenth controllable switches T1-T13 are N-type thin film transistors. In another embodiment, the first to thirteenth controllable switches T1-T13 may be other types of switches, as long as achieve the purpose of the present disclosure.

In the present embodiment, the present level transmission signal is ST(n−2), the first clock signal is CK, the second clock signal is GCK, the pull-up control signal is Q(n) and the third clock signal is XCK.

Figure 11:
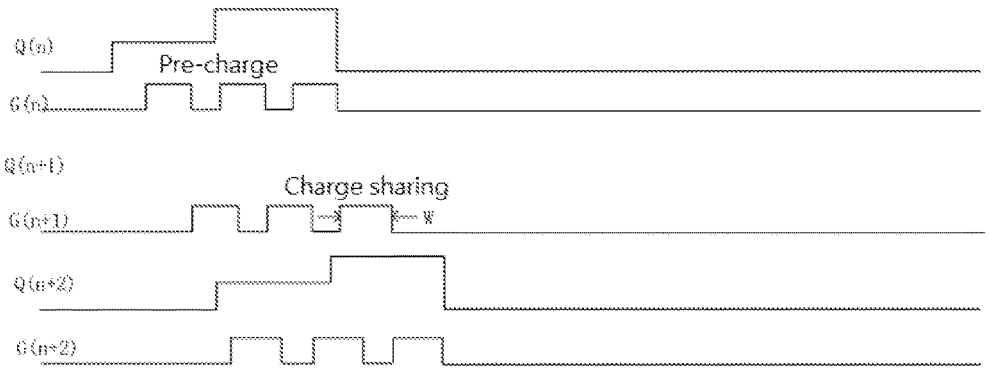
FIG. 11 is an output waveform diagram of the scanning driving circuit in the FIG. 10.

Please refer to FIG. 11, FIG. 11 is an output waveform diagram of the second embodiment of the scanning driving circuit of the present disclosure. FIG. 10 is a circuit diagram use 6CK as an example, the first clock signal CK is used to output the present level transmission signal ST(n), the second clock signal is used to output the scanning driving signal, the frequency of the first clock signal CK in the FIG. 11 is more lower and is ⅓ of the second clock signal GCK, the scanning driving signal is composed by three discrete pulses, wherein the first and second pulses are used to pre-charging, the third pulse is the present level pixel charge, the last pulse of the next level scanning driving circuit outputted is used to charge sharing the Sub area of the present level pixel, the waveform of two adjacent gate lines in FIG. 11 without the portion of pulse overlapping, thus it is used to pixel driving the structure of charge sharing.

Similarly, the 8CK scanning driving signal design also can be used, the circuit diagram may be employed the circuit structure of FIG. 7 or FIG. 10, when the frequency of the first clock signal CK is ¼ of the frequency of the second clock signal GCK, the output of the scanning driving signal of the scanning driving circuit is composed by four discrete pulses, the first to third pulses are used to pre-charging, the fourth pulse is used to charge the present level pixel.

Figure 12:
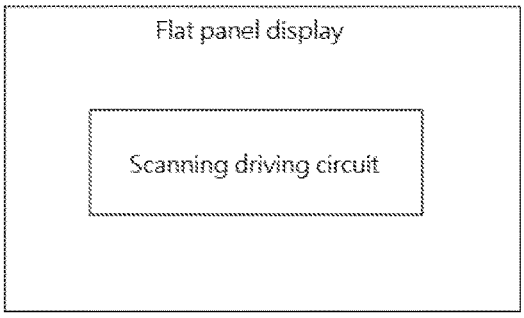
FIG. 12 is a schematic diagram of the flat panel display of the present disclosure.

Please refer to FIG. 12, FIG. 12 is a schematic diagram of the flat panel display of the present disclosure. The flat panel display includes the scanning driving circuit of above, the other apparatuses and functions of the flat panel display are equal to the apparatuses and functions of the existing flat panel display, not discussed here.

The scanning driving circuit makes the scanning driving signal waveform of each scanning driving units outputted of the scanning driving circuit without overlapping portion through the design of the input circuit, the control circuit and the output circuit, in order to meeting the driving demand of the charge sharing pixel while ensure the high aperture ratio of the charge sharing pixel and not affect the reliability of the scanning driving circuit.

The above-described embodiments of the disclosure only, and not so to limit the patent scope of the present disclosure, any use of the accompanying drawings and the description of the present disclosure is made equivalent structures or equivalent processes transform, or direct or indirect use in other Related technical fields, are included within the same reason patentable scope of the disclosure.

What is claimed is:

1. A scanning driving circuit, wherein, the scanning driving circuit comprises a plurality of cascaded scanning driving units, each scanning driving unit comprises:

an input circuit used to receive a previous-stage transmission signal, a first clock signal, a second clock signal and output a current-stage transmission signal and a pull-up control signal according to the received previous-stage transmission signal, the received first clock signal and the received second clock signal;

an output circuit connected with the input circuit and used to receive the current-stage transmission signal and the pull-up control signal from the input circuit and pull down the current-stage transmission signal and the pull-up control signal;

a control circuit connected with the input circuit and used to receive a first pull-down signal, a second pull-down signal and the pull-up control signal and output the scanning driving signal according to the received first pull-down signal, the received second pull-down signal and the received pull-up control signal, or is used to receive the first clock signal, the previous-stage transmission signal, the third clock signal and the pull-up control signal and output the scanning driving signal according to the first clock signal, the previous-stage transmission signal, the third clock signal and the pull-up control signal;

and a scan line connected with a pixel unit used to receive the scanning driving signal from the control circuit and control the pixel unit according to the received scanning driving signal.

2. The scanning driving circuit according to claim 1, wherein, the input circuit comprises first to third controllable switches and capacitor, the control terminal of the first controllable switch connects the first end of the first controllable switch and receives the previous-stage transmission signal, the second end of the first controllable switch connects the control circuit, the output circuit and the control terminal of the second controllable switch, the first end of the second controllable switch receives the first clock signal, the first end of the capacitor connects the control terminal of the second controllable switch and outputs the pull-up control signal, the second end of the second controllable switch connects the second end of the capacitor and outputs the current-stage transmission signal, the control terminal of the third controllable switch connects the control terminal of the second controllable switch, the first end of the third controllable switch connects the second clock signal, the second end of the third controllable switch connects the scan line.

3. The scanning driving circuit according to claim 2, wherein, the output circuit comprises fourth to fifth controllable switches, the control terminal of the fourth controllable switch connects with the control terminal of the fifth controllable switch, the first end of the fourth controllable switch connects the second end of the first controllable switch, the first end of the fifth controllable switch connects the scan line, the second ends of the fourth and fifth controllable switch are grounded.

4. The scanning driving circuit according to claim 3, wherein, the control circuit comprises sixth to seventeenth controllable switches, the control terminal of the sixth controllable switch connects the first end of the sixth controllable switch and the first end of the eighth controllable switch and receives the first pull-down signal, the second end of the sixth controllable switch connects the control terminal of the eighth controllable switch and the first end of the seventh controllable switch, the control terminal of the seventh controllable switch connects the control terminal of the ninth controllable switch and receives the pull-up control signal, the second end of the eight controllable switch connects the control terminal of the tenth controllable switch, the control terminal of the eleventh controllable switch and the first end of the ninth controllable switch, the first end of the tenth controllable switch connects the second end of the first controllable switch, the first end of the eleventh controllable switch connects the scan line, the control terminal of the twelfth controllable switch connects the first end of the twelfth controllable switch and the first end of the fourteenth controllable switch and receives the second pull-down signal, the second end of the twelfth controllable switch connects the control terminal of the fourteenth controllable switch and the first end of the thirteenth controllable switch, the control terminal of the thirteenth controllable switch connects the control terminal of the fifteenth controllable switch and receives the pull-up control signal, the second end of the fourteenth controllable switch connects the control terminal of the sixteenth controllable switch, the control terminal of the seventeenth controllable switch and the first end of the fifteenth controllable switch, the first end of the sixteenth controllable switch connects the second end of the first controllable switch, the first end of the seventeenth controllable switch connects the scan line, the seventh controllable switch, the ninth controllable switch, the tenth controllable switch, the eleventh controllable switch, the thirteenth controllable switch, the fifth controllable switch, the sixteenth controllable switch and the second end of the seventeenth controllable switch are grounded.

5. The scanning driving circuit according to claim 3, wherein, the control circuit comprises sixth to thirteenth controllable switches, the control terminal of the sixth controllable switch connects the first end of the sixth controllable switch and the first end of the eighth controllable switch and receives the first clock signal, the second end of the sixth controllable switch connects the control terminal of the eighth controllable switch and the first end of the seventh controllable switch, the control terminal of the seventh controllable switch connects the control terminal of the ninth controllable switch and receives the pull-up control signal, the second end of the eighth controllable switch connects the control terminal of the tenth controllable switch, the control terminal of the eleventh controllable switch and the first end of the ninth controllable switch, the first end of the tenth controllable switch connects the second end of the first controllable switch, the first end of the eleventh controllable switch connects the scan line, the control terminal of the twelfth controllable switch connects the control terminal of the thirteenth controllable switch and receives the third clock signal, the first end of the twelfth controllable switch connects the second end of the first controllable switch, the second end of the twelfth controllable switch connects the previous-stage transmission signal, the first end of the thirteenth controllable switch connects the scan line, the second ends of the seventh controllable switch, the ninth controllable switch, the tenth controllable switch, the eleventh controllable switch and thirteenth controllable switch are grounded.

6. The scanning driving circuit according to claim 1, wherein, the frequency of the first clock signal is half of the frequency of the second clock signal, the scanning driving signal is constituted by two discrete pulse signals, the first pulse signal is used to pre-charging, the second pulse signal is used to charge a current-stage pixel.

7. The scanning driving circuit according to claim 1, wherein, the frequency of the first clock signal is ⅓ of the frequency of the second clock signal, the scanning driving signal is constituted by three discrete pulse signals, the first and the second pulse signals are used to pre-charging, the third pulse signal is used to charge a current-stage pixel.

8. The scanning driving circuit according to claim 1, wherein, the frequency of the first clock signal is ¼ of the frequency of the second clock signal, the scanning driving signal is constituted by four discrete pulse signals, the first to third pulse signal are used to pre-charging, the fourth pulse signal is used to charge a current-stage pixel.

9. The scanning driving circuit according to claim 4, wherein, the first to seventeenth controllable switches are N-type thin film transistors.

10. The scanning driving circuit according to claim 5, wherein, the first to thirteenth controllable switches are N-type thin film transistors.

11. A flat panel display, wherein, the flat panel display comprises a scanning driving circuit, wherein, the scanning driving circuit comprises a plurality of cascaded scanning driving units, each scanning driving unit comprises:

an input circuit used to receive a previous-stage transmission signal, a first clock signal, a second clock signal and output a current-stage transmission signal and a pull-up control signal according to the received previous-stage transmission signal, the received first clock signal and the received second clock signal;

an output circuit connected with the input circuit and used to receive the current-stage transmission signal and the pull-up control signal from the input circuit and pull down the current-stage transmission signal and the pull-up control signal;

a control circuit connected with the input circuit and used to receive a first pull-down signal, a second pull-down signal and the pull-up control signal and output the scanning driving signal according to the received first pull-down signal, the received second pull-down signal and the received pull-up control signal, or is used to receive the first clock signal, the previous-stage transmission signal, the third clock signal and the pull-up control signal and output the scanning driving signal according to the first clock signal, the previous-stage transmission signal, the third clock signal and the pull-up control signal;

and a scan line connected with a pixel unit used to receive the scanning driving signal from the control circuit and control the pixel unit according to the received scanning driving signal.

12. The flat panel display according to claim 11, wherein, the input circuit comprises first to third controllable switches and capacitor, the control terminal of the first controllable switch connects the first end of the first controllable switch and receives the previous-stage transmission signal, the second end of the first controllable switch connects the control circuit, the output circuit and the control terminal of the second controllable switch, the first end of the second controllable switch receives the first clock signal, the first end of the capacitor connects the control terminal of the second controllable switch and outputs the pull-up control signal, the second end of the second controllable switch connects the second end of the capacitor and outputs the current-stage transmission signal, the control terminal of the third controllable switch connects the control terminal of the second controllable switch, the first end of the third controllable switch connects the second clock signal, the second end of the third controllable switch connects the scan line.

13. The flat panel display according to claim 12, wherein, the output circuit comprises fourth to fifth controllable switches, the control terminal of the fourth controllable switch connects with the control terminal of the fifth controllable switch, the first end of the fourth controllable switch connects the second end of the first controllable switch, the first end of the fifth controllable switch connects the scan line, the second ends of the fourth and fifth controllable switch are grounded.

14. The flat panel display according to claim 13, wherein, the control circuit comprises sixth to seventeenth controllable switches, the control terminal of the sixth controllable switch connects the first end of the sixth controllable switch and the first end of the eighth controllable switch and receives the first pull-down signal, the second end of the sixth controllable switch connects the control terminal of the eighth controllable switch and the first end of the seventh controllable switch, the control terminal of the seventh controllable switch connects the control terminal of the ninth controllable switch and receives the pull-up control signal, the second end of the eight controllable switch connects the control terminal of the tenth controllable switch, the control terminal of the eleventh controllable switch and the first end of the ninth controllable switch, the first end of the tenth controllable switch connects the second end of the first controllable switch, the first end of the eleventh controllable switch connects the scan line, the control terminal of the twelfth controllable switch connects the first end of the twelfth controllable switch and the first end of the fourteenth controllable switch and receives the second pull-down signal, the second end of the twelfth controllable switch connects the control terminal of the fourteenth controllable switch and the first end of the thirteenth controllable switch, the control terminal of the thirteenth controllable switch connects the control terminal of the fifteenth controllable switch and receives the pull-up control signal, the second end of the fourteenth controllable switch connects the control terminal of the sixteenth controllable switch, the control terminal of the seventeenth controllable switch and the first end of the fifteenth controllable switch, the first end of the sixteenth controllable switch connects the second end of the first controllable switch, the first end of the seventeenth controllable switch connects the scan line, the seventh controllable switch, the ninth controllable switch, the tenth controllable switch, the eleventh controllable switch, the thirteenth controllable switch, the fifth controllable switch, the sixteenth controllable switch and the second end of the seventeenth controllable switch are grounded.

15. The flat panel display according to claim 13, wherein, the control circuit comprises sixth to thirteenth controllable switches, the control terminal of the sixth controllable switch connects the first end of the sixth controllable switch and the first end of the eighth controllable switch and receives the first clock signal, the second end of the sixth controllable switch connects the control terminal of the eighth controllable switch and the first end of the seventh controllable switch, the control terminal of the seventh controllable switch connects the control terminal of the ninth controllable switch and receives the pull-up control signal, the second end of the eighth controllable switch connects the control terminal of the tenth controllable switch, the control terminal of the eleventh controllable switch and the first end of the ninth controllable switch, the first end of the tenth controllable switch connects the second end of the first controllable switch, the first end of the eleventh controllable switch connects the scan line, the control terminal of the twelfth controllable switch connects the control terminal of the thirteenth controllable switch and receives the third clock signal, the first end of the twelfth controllable switch connects the second end of the first controllable switch, the second end of the twelfth controllable switch connects the previous-stage transmission signal, the first end of the thirteenth controllable switch connects the scan line, the second ends of the seventh controllable switch, the ninth controllable switch, the tenth controllable switch, the eleventh controllable switch and thirteenth controllable switch are grounded.

16. The flat panel display according to claim 11, wherein, the frequency of the first clock signal is half of the frequency of the second clock signal, the scanning driving signal is constituted by two discrete pulse signals, the first pulse signal is used to pre-charging, the second pulse signal is used to charge a current-stage pixel.

17. The flat panel display according to claim 11, wherein, the frequency of the first clock signal is ⅓ of the frequency of the second clock signal, the scanning driving signal is constituted by three discrete pulse signals, the first and the second pulse signals are used to pre-charging, the third pulse signal is used to charge a current-stage pixel.

18. The flat panel display according to claim 11, wherein, the frequency of the first clock signal is ¼ of the frequency of the second clock signal, the scanning driving signal is constituted by four discrete pulse signals, the first to third pulse signal are used to pre-charging, the fourth pulse signal is used to charge a current-stage pixel.

19. The flat panel display according to claim 14, wherein, the first to seventeenth controllable switches are N-type thin film transistors.

20. The flat panel display according to claim 15, wherein, the first to thirteenth controllable switches are N-type thin film transistors.

* * * * *